United States Patent [19]

Rodriguez, Jr. et al.

[11] Patent Number: 4,533,138

[45] Date of Patent: Aug. 6, 1985

[54] MULTIPLE SPORT TRAINING DEVICE

[75] Inventors: Alfonzo S. Rodriguez, Jr.; Jeffrey A. Anderson, both of Belmond, Iowa

[73] Assignee: Robert L. Wright, Des Moines, Iowa

[21] Appl. No.: 384,105

[22] Filed: Jun. 1, 1982

[51] Int. Cl.[3] ..... A63B 69/40

[52] U.S. Cl. ..... 273/26 R; 272/78; 272/135; 273/26 A; 273/55 R; 273/395; 273/407

[58] Field of Search ..... 273/26 R, 26 E, 26 A, 273/29 R, 29 A, 55 R, 1.5 A; 248/156, 185, 413; 272/130, 78, 123, 132, 142; 254/11-17, 3, 93 R, 93 L, 93 A, 2 B, 2 C, 98

[56] References Cited

U.S. PATENT DOCUMENTS

| | | | |
|---|---|---|---|
| 528,779 | 11/1894 | Kellogg | 272/130 |
| 1,101,598 | 6/1914 | Weinke | 187/9 R |
| 1,227,646 | 5/1917 | Metz | 187/9 R |
| 2,106,878 | 2/1938 | Sinclair | 254/2 C |
| 2,986,395 | 5/1961 | Sheftel | 272/78 |
| 3,346,256 | 10/1967 | White | 272/123 |
| 3,386,733 | 6/1968 | Russo et al. | 273/26 R |
| 3,475,026 | 10/1969 | Cooper | 273/26 E |
| 4,097,044 | 6/1978 | Miniere | 273/26 R |

*Primary Examiner*—Richard C. Pinkham
*Assistant Examiner*—T. Brown
*Attorney, Agent, or Firm*—Zarley, McKee, Thomte, Voorhees & Seas

[57] ABSTRACT

A multiple sport training device which includes a stabilizing base and a vertical support. A vertically adjustable carriage is positioned on the vertical support. Connecting members extend from opposite sides of the carriage for reception of attachment members which are used for sports skills training purposes. The attachment members are rotatable around a horizontal axis so that their vertical attitude may be adjusted. Batting training devices, ball rebounders, catching nets, and batting tees comprise some of the attachment members. Additionally, the vertical support is foldable against the stabilizing base for easy storage and transport wheels are insertable into one of the connecting members to allow easy movement of the device when tilted on its side.

9 Claims, 7 Drawing Figures

MULTIPLE SPORT TRAINING DEVICE

BACKGROUND OF THE INVENTION

1. Field of the Invention

This invention relates to a device for sports skills training purposes, more particularly, a device for multiple sports skills training having a plurality of interchangeable attachments for the training and sharpening of various sports skills.

2. Description of Prior Art

The pervasiveness of sports throughout all segments of our society has led to the development of training mechanisms to teach and develop sports skills.

In the past, devices have been made which are aimed specifically at refining the skills of one or two specific athletic skills. Examples of these devices are Russo, et al., Batting Practice Device, U.S. Pat. No. 3,386,733 which is aimed at increasing a batter's strength and skills; Hazen, U.S. Pat. No. 4,092,023, Sport Training Device, which is aimed at improving the accuracy of a sport participant in the throwing or kicking of a ball; Martin, Tennis Practice and Teaching Rebounder, U.S. Pat. No. 4,082,271, which is directed to rebounding objects thrown at it so as to serve as a practice backstop for tennis; and Scheemaeker, Baseball Pitching Practice Target Device, U.S. Pat. No. 3,172,661, a device which presents a target and collection net to develop the accuracy and throwing of a baseball.

A major limitation of these devices is that they serve to train users in one specific skill only. Therefore, training in multiple sports skills requires multiple equipment which is expensive and cumbersome to implement. Even rebounding devices such as Martin allow a limited range of drills or practice.

Many of the training devices heretofore made are not adjustable to correspond to various heights of users or varying attitudes for different uses. Most of the prior devices are not easily storable or transportable and are cumbersome to adjust, if they are adjustable.

The other devices in the field also do not allow simultaneous training of two different skills and they are not adaptable for application to training for a variety of athletic sports programs.

There is a real need for a sports training device which is versatile, flexible and economical.

It is therefore an object of this invention to provide a sports training device which is easily adaptable to different sports training attachments.

A further object of this invention is to provide a sports training device which can be used to train for a variety of sports.

A further object of this invention is to provide a sports training device which can be used year around.

Another object of this invention is to provide a sports training device which is easily moved from place to place.

Another object of this invention is to provide a sports training device which can be easily stored in a narrow storage area.

A further object of this invention is to provide a sports training device which can be easily moved through standard sized doorways.

Another object of this invention is to provide a sports training device which can be used with different teaching techniques, and in teaching different skills.

A further object of this invention is to provide a sports training device which is economical, durable, and requires little or no maintenance with a long life.

Another object of this invention is to provide a sports training device which allows quick and easy vertical height adjustment of the interchangeable attachments.

A further object of this invention is to provide a sports training device which allows easy, angular tilting of the interchangeable attachments.

Additional objects, features, and advantages of the invention will become apparent with reference to the accompanying specification and drawings.

SUMMARY OF THE INVENTION

This invention utilizes a durable and rigid framework having a large area base and a vertical support extending upwardly from the center of the base. A carriage assembly is vertically adjustable over most of the distance of the vertical support. The carriage has two oppositely extending horizontal connecting members to which are rotatably mounted interchangeable sports training attachments.

The carriage is vertically adjustable so that the height of the sports training attachments can be adjusted to the preference of the use or the user. Likewise, the sports training attachments are rotatable around a horizontal axis so that the vertical attitude of the attachments may be quickly and easily adjusted for the benefit of different uses and training techniques.

The sports training attachments are universally interchangeable on either side and the changes can be made in seconds. The vertical and tilting adjustments can be made quickly and by hand, requiring no special tools.

Additionally, a transport wheel assembly may be inserted into one of the connecting members, the device may then be tipped down upon the wheels, the base may be folded against the vertical support (which is now lying laterally supported by the wheels), and the base and vertical support may be locked together so that the entire device may be easily transported. By folding the base against the vertical support, the device assumes a very narrow configuration as the base and supports are substantially in the same plane. This enables the device to be easily passed through standard doorways and stored without taking up a large floor space area.

A number of sports training attachments have been developed for use with the invention and they will be explained in more detail herein. Among the attachments is a batting training device which includes a tire, such as an automobile tire, attached at one side to the connecting member of the carriage and at the opposite side having a slit cut through the entire tire.

The tire attachment may then be raised or lowered to accommodate the batter's height, while it may also be tilted forward or backward to teach down swing or upward swing batting, as opposed to level swing batting.

DETAILED DESCRIPTION OF THE PREFERRED EMBODIMENT

Figure 1:
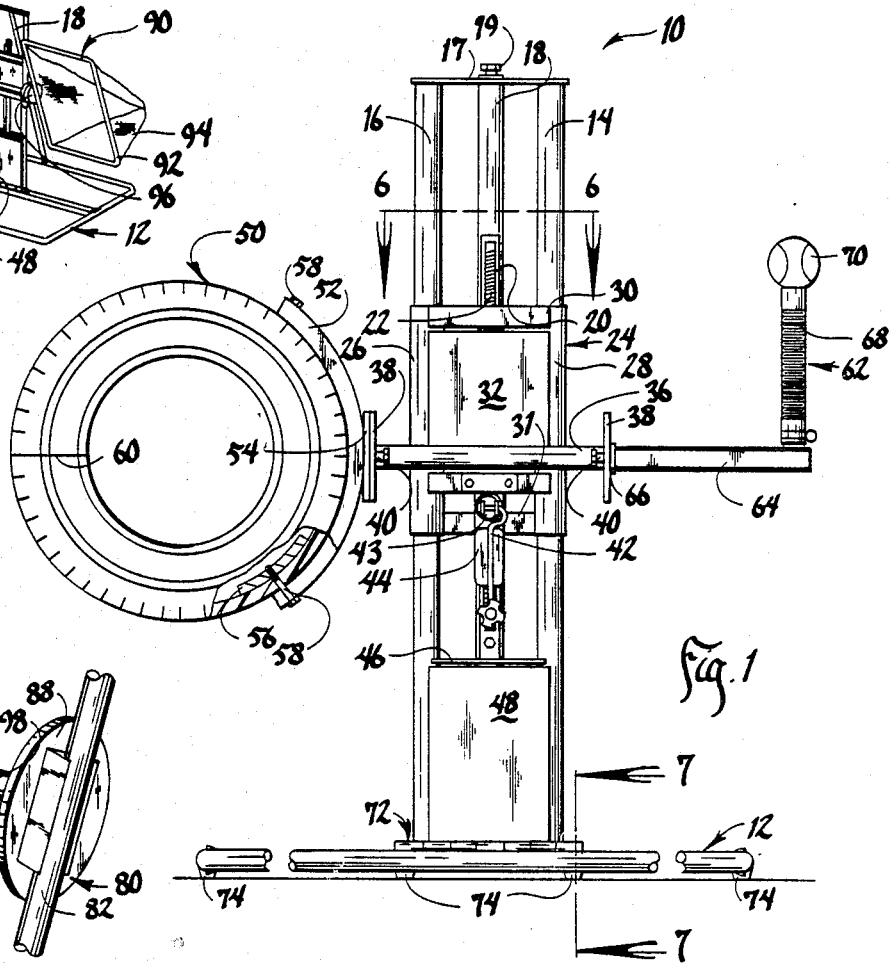
FIG. 1 is a front plan view of the invention.

In reference to the drawings, and particularly FIG. 1, there is shown a sports training device 10 in accordance with the invention. Stabilizing base 12 provides a rigid tubular base from which extend a vertical support comprised of vertical support tubes 14 and 16. Top cross bar 17 provides a fastening junction for angular support bar 18 which is fastened to cross bar 17 by means of hand-turned fastener 19, and fastened to the backside of frame 12 by hand-turned fastener 108.

Vertical adjustment bar 20 is between vertical support bars 14 and 16 and contains stepped-teeth 22 along its front surface. Carriage member 24 is vertically adjustable along the stepped teeth 22 of vertical adjustment bar 20 and is comprised of tubular sleeves 26 and 28 which slidably surround vertical supports 14 and 16. Sleeves 26 and 28 are connected by cross pieces 30, 32 and 34.

A horizontally mounted tube 36 having circular flanges 38 at opposite ends comprises the attachment connecting member to which the sports training attachments are mounted and secured by hand-turned fasteners 40. Tube 36 is secured to carriage 24 and moves according to the vertical adjustments of carriage 24.

Carriage 24 is adjusted vertically upward or downward by the clockwise or counterclockwise turning of handle 42 which is connected to gearing mechanism 43 which mates with stepped teeth 22. Plate 44 covers gearing mechanism 43 and provides a downward stop for carriage 24. Support bar 46 fastens at opposite ends to vertical supports 14 and 16 and connects to the lower end of vertical adjustment bar 20. Facing plate 48 extends down to the lower ends of vertical supports 14 and 16.

Attachment connecting member 36 can receive a number of sports training attachments, two of which are shown in FIG. 1. A batting training attachment includes a tire 50 which has external concave plates 52 attached to internal convex plates 56 by fastening bolts 58. External plates 52 are in turn connected to circular flange 54 which is held onto connecting flange 38 by hand-turned fasteners 40. A slit 60 is cut through the opposite side of tire 50 and provides a target for training a batter's swing. Additionally, by swinging the bat through slit 60 of tire 50, the batter's arm and shoulder strength is increased.

Vertical adjustment of carriage 24 allows for different user height, and is accomplished by the simple turning of handle 42. By changing the ply of tire 50, the batting resistance is increased or decreased and therefore the attachment can be accommodated to all athletes, regardless of their stage of development.

A batting tee 62 is another example of an attachment which can be utilized by the device 10 and includes an extension tube 64 which removably joins flange 38 by the connection of hand-turned fastener 40 to rectangular flange 66, which is secured to the end of tube 64. Resilient, flexible batting tee 68 extends upward from the outside end of tube 64 and holds ball 70 in preparation for batting practice by the user. Again, height of ball 70 is adjustable to the batter by virtue of adjustment of carriage 24.

Figure 2:
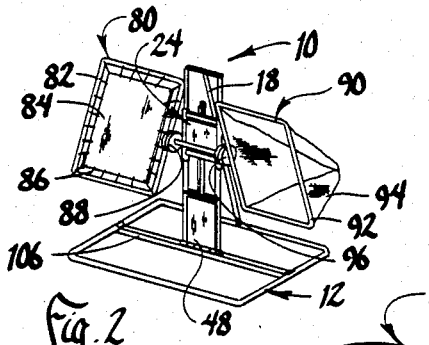
FIG. 2 is a front perspective view of the invention with two different sports training attachments.

Additional examples of attachments can be seen with reference to FIG. 2. Tiltable rebounder 80 includes a rigid rectangular tubular frame 82 which retains resilient rebounding surface 84 by springs 86. Rebounding surface 84 may be made of durable nylon, while springs 86 may be stainless steel for long-lasting use. Frame 82 is connected at one vertical side to flange 88 which is in turn rotatably connected to flange 38. Rebounder 80 may therefore be tilted to any angle to facilitate a multitude of training uses. Rebounder 80 may also be placed in a frame horizontally on the floor and used as a jogger for runners, particularly those with injuries to their legs.

Catching net 90 includes a rectangular rigid tubular frame 92 rotatably fastened to flange 38 by flange 96 and has a net 94 snapped around frame 92 for the reception of objects entering through frame 92. Catching net 90 may be used for a variety of purposes, including catching baseballs, catching footballs when practicing kicking or passing, catching soccer balls when practicing kicks, and many other uses. The tiltability of catching net 90 increases its utility.

Figure 3:
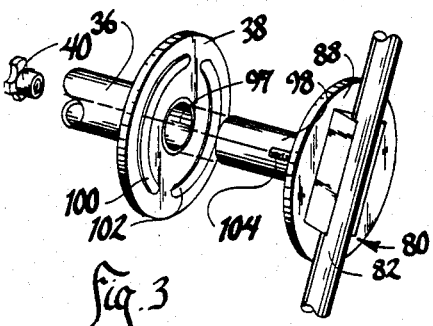
FIG. 3 is a partial perspective view of the rotatable connecting means of the invention.

Referring now to FIG. 3, the structure which allows tiltability of the attachments is shown in greater detail. Flange 38 is fastened around the end of tube 36 leaving an opening 97 into tube 36. Curved slots 100 and 102 extend arcuately around flange 38. A sports training attachment such as rebounder 80 is then mounted to attachment tube 36 and flange 38 by first inserting tube 98 into opening 97. This serves to stabilize and steady the attachment. Flange 88 of attachment 80 has threaded studs 104 which extend out from flange 88 and match the radial distance to slots 100 and 102 of flange 38. Flanges 88 and 38 are drawn together, studs 104 enter through slots 100 and 104, the attachment is placed in the preferred position of use by the user, and hand-turned fasteners 40 are fastened down upon nuts 104. Tilting of attachment 80 is quickly and easily accomplished by loosening fasteners 40, turning the attachment to the desired position, and then retightening fasteners 40.

Figure 4:
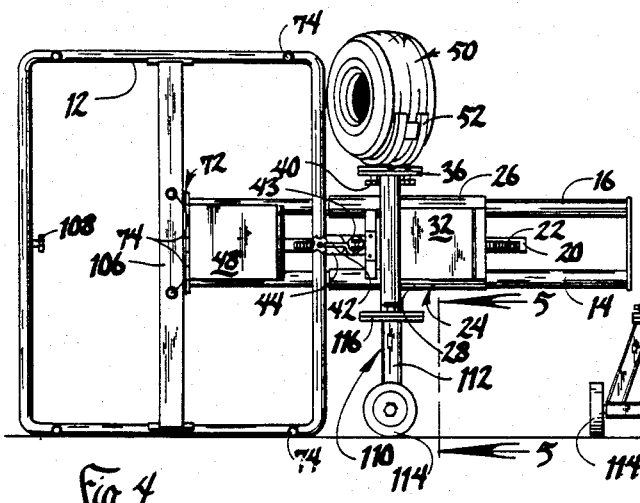
FIG. 4 is a plan view of the invention in its storage and transport configuration.

Device 10 is easily stored and transported, as depicted in FIG. 4. Vertical supports 14 and 16 are mounted upon hinge member 74 which in turn is mounted upon base cross support 106 of base frame 12. This allows the vertical supports 14 and 16 and all the structure associated with it, to be folded against base frame 12 so that the entire structure lies in essentially the same plane. To secure the vertical structure with base frame 12, carriage unit 24 is adjusted down so that the cover plate 44 passes over the bottom side of base frame 12 while the top side is secured against supports 14 and 16.

Figure 5:
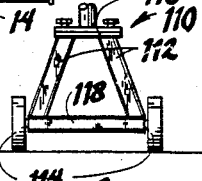
FIG. 5 is a plan view of the transport wheel assembly as taken along lines 5—5.

Transport cart assembly 110 can be inserted into either end of tube 36 in the identical manner of a sports attachment. With reference to FIG. 5, it can be seen that cart assembly 110 has a top flange similar to flange 88 as shown in FIG. 3. Support braces 112 diverge down to axle member 118 having rotatable wheels mounted on opposite ends. Device 10 can therefore be tilted on its side and easily transported by one person. This foldable configuration allows device 10 to be stored in an area which is 26 inches wide.

Figure 6:
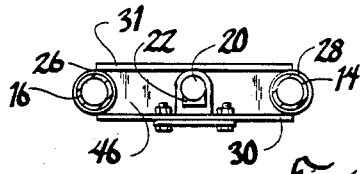
FIG. 6 is a sectional view taken along line 6—6 of FIG. 1.

FIG. 6 reveals the general structure of carriage unit 24. Carriage sleeves 26 and 28 slidably surround vertical supports 16 and 14. Sleeves 26 and 28 are connected at numerous places by cross-supports 30 and 31. By operation of gear mechanism 43 along stepped teeth 22 of vertical adjustment rod 20, the carriage unit 24 slides vertically up and down along support tubes 14 and 16 in a sturdy, non-binding manner. Gear mechanism 43 is bolted to cross-support 34.

Figure 7:
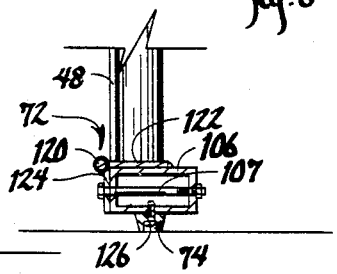
FIG. 7 is a partial sectional view taken along line 7—7 of FIG. 1.

The structure of hinge member 72 is more specifically set out in FIG. 7. Hinge plate 122 is secured to the bottoms of vertical supports 14 and 16 while hinge plate 124 is bolted to the vertical side of base cross support 106 by bolts 107. Hinge mechanism 120 allows the folding of device 10 for transport and storage. Additionally, FIG. 7 reveals how rubber base feet 74 are attached to base frame 12 by fastening screws 126. Base feet 74 allow device 10 to be used inside such as on gymnasium floors so that device 10 can be used year around.

The operation of device 10 has been covered in the above description. It should also be noted that the above description is the preferred embodiment of the invention and changes may be made which are obvious to those skilled in the art and remain within the boundaries of the invention.

Other sports training attachments may be developed and used within the scope of this invention. Examples would be vertically adjustable basketball rebounding training attachments having a collapsible rim; boxing bag and dummy attachments; football pass blocking dummies (free-hanging); and an adjustable bar to teach proper overhand throwing techniques.

What is claimed is:

1. A multiple sport training device having interchangeable sport training attachments which may be selectively used and positioned at desired heights and angular orientations comprising:

a rigid support frame having a base and a generally vertically extending support having two parallel tubular members attached at their lower ends to said base and having cross supports between said tubes;

a vertically adjustable carriage mounted upon said vertically extending support, said vertically adjustable carriage comprising two tubular sleeves which slidably fit over said tubular members, said sleeves being inter-connected by a crossbar;

a vertical adjustment means comprising an elongated bar mounted between said tubular members, having a plurality of evenly spaced teeth along its length, said carriage being vertically adjustable along said elongated bar; means for changing and securing the position of said carriage along said vertically extending support; and connector means mounted to said carriage for reception of said attachments, said connector means having means for selectively adjusting and securing said attachments at different attitudes around a horizontal axis so that said attachments can be presented at different selected attitudes to the user of said device.

2. The device of claim 1 wherein said attachment comprises a resilient member having an enclosed opening, said resilient member having a mounting shoe which is attached to said connector means allowing vertical attitude adjustment of said resilient member, said resilient member having a horizontal slit through its width at its side opposite said connector means for batting training.

3. The device of claim 1 wherein said attachment member comprises a rebound trampoline having a rectangular frame, so that an object striking said trampoline member rebounds according to the vertical attitude of said trampoline rebounder.

4. The device of claim 1 wherein said attachment member comprises a catching net having a rectangular frame, so that objects entering within the interior area of said frame are retained in said net.

5. The device of claim 1 wherein said attachment member comprises a batting tee having an extension member extending away from said vertical support, the outermost end of said extension member having a vertically extending batting tee attached to it.

6. The device of claim 1 wherein said vertically extending support is foldable at its junction with said base so that said vertically extending support may be folded down against said base to allow storage of said device.

7. The device of claim 1 wherein a transport cart assembly, having a frame with rollable wheels, is mounted on said connector means to allow easy transport of said multiple sport training device.

8. The device of claim 1 wherein said means to secure and change the vertical position of said carriage comprises a worm gear drive having a manually operated handle.

9. The device of claim 1 wherein said means for selectively adjusting and securing said attachment members at different attitudes comprises a first flange attached to said carriage having curved slots concentric with the horizontal axis, and a second flange attached to said attachment means having pins extending perpendicularly of said second flange and being matable with said slots of said first flange, so that upon mating of said pins with said slots, said pins can be adjusted in said slots to achieve the desired position of said attachment and said flanges can be secured in that respective position.

* * * * *